US008065765B2

(12) United States Patent
Rincon

(10) Patent No.: US 8,065,765 B2
(45) Date of Patent: Nov. 29, 2011

(54) FOLDABLE PATIENT TRANSPORT SURFACE

(76) Inventor: Frank Rincon, Spring Branch, TX (US)

( * ) Notice: Subject to any disclaimer, the term of this patent is extended or adjusted under 35 U.S.C. 154(b) by 0 days.

(21) Appl. No.: 12/622,648

(22) Filed: Nov. 20, 2009

(65) Prior Publication Data

US 2011/0119831 A1 May 26, 2011

(51) Int. Cl.
*A47B 1/00* (2006.01)

(52) U.S. Cl. ..... 5/627; 5/625; 5/81.1 R

(58) Field of Classification Search ..... 5/625, 627, 5/89.1, 81.1 R, 120
See application file for complete search history.

(56) References Cited

U.S. PATENT DOCUMENTS

| | | | | |
|---|---|---|---|---|
| 4,422,454 | A | 12/1983 | English | |
| 4,627,428 | A | 12/1986 | Brooks | |
| 4,700,416 | A | 10/1987 | Johansson | |
| 4,944,057 | A | 7/1990 | Shaw | |
| 5,214,813 | A | 6/1993 | Gastle et al. | |
| 5,515,549 | A * | 5/1996 | Wang | 5/625 |
| 5,839,137 | A | 11/1998 | Butler et al. | |
| 5,978,989 | A | 11/1999 | Chavez | |
| 6,122,778 | A | 9/2000 | Cohen | |
| 6,128,796 | A | 10/2000 | McCormick et al. | |
| D433,509 | S | 11/2000 | Strauch et al. | |
| 6,477,728 | B1 * | 11/2002 | Faz | 5/625 |
| 6,634,044 | B1 | 10/2003 | Wright | |
| 6,851,145 | B2 | 2/2005 | Smith et al. | |
| 6,883,190 | B2 | 4/2005 | Carbonneau et al. | |
| D506,710 | S | 6/2005 | Hurtado | |
| 7,168,110 | B2 | 1/2007 | Girard et al. | |
| 7,360,543 | B1 | 4/2008 | Coleman et al. | |
| 7,774,878 | B1 * | 8/2010 | Florea et al. | 5/627 |
| 2002/0162171 | A1 * | 11/2002 | Faz | 5/627 |

* cited by examiner

*Primary Examiner* — Robert G Santos
*Assistant Examiner* — Brittany Wilson
(74) *Attorney, Agent, or Firm* — Kammer Browning PLLC

(57) ABSTRACT

A collapsible, foldable transport surface capable of supporting an individual when carried by one or more assisting personnel utilizing hand hold components. The transport surface includes a primary body support surface and a secondary leg extension support surface that are connected together. The primary body support surface incorporates an array of straps extending across the back side thereof to form loop based hand holds positioned on the side edges of the transport surface. A set of longitudinally oriented straps are positioned on the support surface and extend from a top edge to form two loop based hand holds which further together terminate into a single loop hand hold at the opposite edge. The secondary leg extension support surface includes a smaller array of straps that extend across the extension support surface forming additional hand holds on either side. The secondary leg extension surface may be retained against the primary support surface when not in use. Each of the loop based hand holds are constructed from flexible tubing through which the support straps are threaded. The balance of the support straps likewise extend across and are sewn to the underside of the support surface. The device may be rolled into a cylindrical configuration and secured utilizing a closure tab. A peripheral strap is positioned on the upper and side edges of the primary support surface to open and fully extend the body support surface.

9 Claims, 5 Drawing Sheets

FOLDABLE PATIENT TRANSPORT SURFACE

BACKGROUND OF THE INVENTION

1. Field of the Invention

The present invention relates generally to systems and methods for transporting incapacitated individuals in emergency and non-emergency situations. The present invention relates more specifically to a collapsible, foldable, transport surface capable of supporting an individual when carried by one or more (preferably two or more) individuals with hand-hold components incorporated onto the edges of the surface.

2. Description of the Related Art

There are many existing devices designed to facilitate the transport of incapacitated individuals in either emergency or non-emergency situations. For the most part these devices comprise rigid, full body length, platforms onto which the incapacitated individual is placed and strapped down or otherwise retained while two or more emergency personnel or healthcare personnel carry or otherwise transport the individual along with the platform on which they have been placed. These existing devices take the form of simple backboards, often configured with foam padding for assisting with the retention of the individual on the backboard, or more complicated stretchers and gurneys that allow transport of the individual over smooth flat surfaces. Most of these devices are designed to be rigid and to accommodate the full body length of the incapacitated individual primarily because spine and neck injuries are frequently associated with the emergency situations wherein the transport surface is called for. In many cases, however, it is clear to those providing the assistance to the incapacitated individual that no such injury is present and a full sized rigid transport device is unnecessary and cumbersome.

A significant problem associated with all of the rigid full length patient transport devices currently in use is the difficulty with which such devices are initially transported to the location of the incapacitated individual and thereafter the difficulty with which the individual and the transport surface are removed from the location. There has been significant need, therefore, for a patient transport surface or transport device that is easily movable in and out of tightly confined environments, both with and without the patient placed on the surface, in a manner that is generally not possible with full sized rigid based transport surfaces.

Some efforts have been made in the past to provide slings, harnesses, and other flexible mechanisms for securing, positioning, and transporting incapacitated individuals. For the most part these devices are difficult to manipulate and place on or around the incapacitated individual and at the same time provide great discomfort to the incapacitated individual during transport. Any number of compact sling or harness devices have been designed and utilized, every one of which is it difficult to safely secure the harness to the incapacitated individual and thereafter to easily facilitate the transport of the individual by two or more assisting personnel.

It would be desirable if a patient transport surface was available that had the size benefits of a smaller, collapsible harness or sling, and at the same time provided the ease of patient placement that is associated with the full sized rigid platform transport surfaces. It would be desirable if such a device were easily collapsible or foldable into a compact transport configuration that could be readily moved to the individual to be assisted. It would be further beneficial if once located near the individual to be assisted, the device could easily unfold or unroll into a configuration that provided simple and direct placement of the patient onto the support surface. Thereafter, it would be desirable if the transport surface could be carried by as few as two, and even possibly only one assisting individual with comfort for the patient being transported. It would be further desirable if the device were adaptable for use by more than two assisting personnel in such a manner that even greater comfort and greater mobility could be afforded the incapacitated individual in tightly confined environments. It would be beneficial if the compact foldable device were adaptable for use in conjunction with the core body components of the incapacitated individual (i.e., did not necessitate support of the legs) or could easily be altered in configuration to provide support of the legs to the incapacitated individual.

SUMMARY OF THE INVENTION

In fulfillment of the above objectives, the present invention provides a collapsible, foldable transport surface capable of supporting an individual when carried by one or more (preferably by two or more) assisting personnel utilizing hand hold components configured on the edges of the transport surface. The transport surface of the present invention is intended for use where it is clear to the assisting personnel that there is no neck or back injury present that would be exacerbated by movement of the neck and/or spine. The transport surface includes a primary support surface and a secondary leg extension support surface that are flexibly connected together in a manner that allows the leg extension support surface to be folded back onto the primary body support surface when not in use. The primary body support surface incorporates an array of straps extending side to side across the surface on a back side thereof to each terminate in loop based hand holds positioned on either of the side edges of the transport surface. A further set of longitudinally oriented straps are positioned on the back side of the primary body support surface and extend from a top edge (where the head of the incapacitated individual is positioned) to form two loop based hand holds which together further terminate into a single loop based hand hold at the opposite longitudinal edge of the primary body support surface.

The secondary leg extension support surface itself includes a smaller array of straps that are positioned on the back side thereof and extend across the leg extension support surface forming additional loop based hand holds on either side. The secondary leg extension support surface may be retained flat against the primary body support surface by means of matching and aligned hook and loop surfaces.

Each of the loop based hand holds are constructed from short lengths of flexible tubing through which the webbing forming the support straps for the device are threaded in order to eliminate the need for any sewn connections at the hand holds. The balance of the support straps likewise extend across and are sewn to the underside of the support surfaces to greatly reduce the likelihood of any sewn connection becoming undone. The device may be rolled into a tight cylindrical configuration and secured in the configuration utilizing a closure tab configured with matching hook and loop retention surfaces. Finally, a peripheral strap of webbing is positioned on the upper and side edges of the primary support surface to lend further stability to the open and fully extended configuration of the body support surface.

DETAILED DESCRIPTION OF THE PREFERRED EMBODIMENTS

The present invention finds application in many different situations where transport of an incapacitated or impaired individual is required. As indicated above, the device of the present invention is intended for use where it is clear to the assisting personnel that there is no neck or back injury present that would be exacerbated by movement of the neck and/or spine. Where there is any uncertainty with respect to the presence of a spinal injury use of a rigid transport device should be preferred over use of the more flexible device of the present invention. Despite this limitation however, there are frequent situations where the individual to be transported is simply unable to move with the speed or certainty that the situation might require. In many cases the individual may simply be disoriented, unconscious or semi-conscious, or have a non-spinal injury that has been stabilized or otherwise addressed. The device of the present invention therefore becomes an indispensible aid in facilitating the transport of such incapacitated individuals in locations where it would be difficult or impossible to use a rigid backboard or stretcher.

Figure 1:
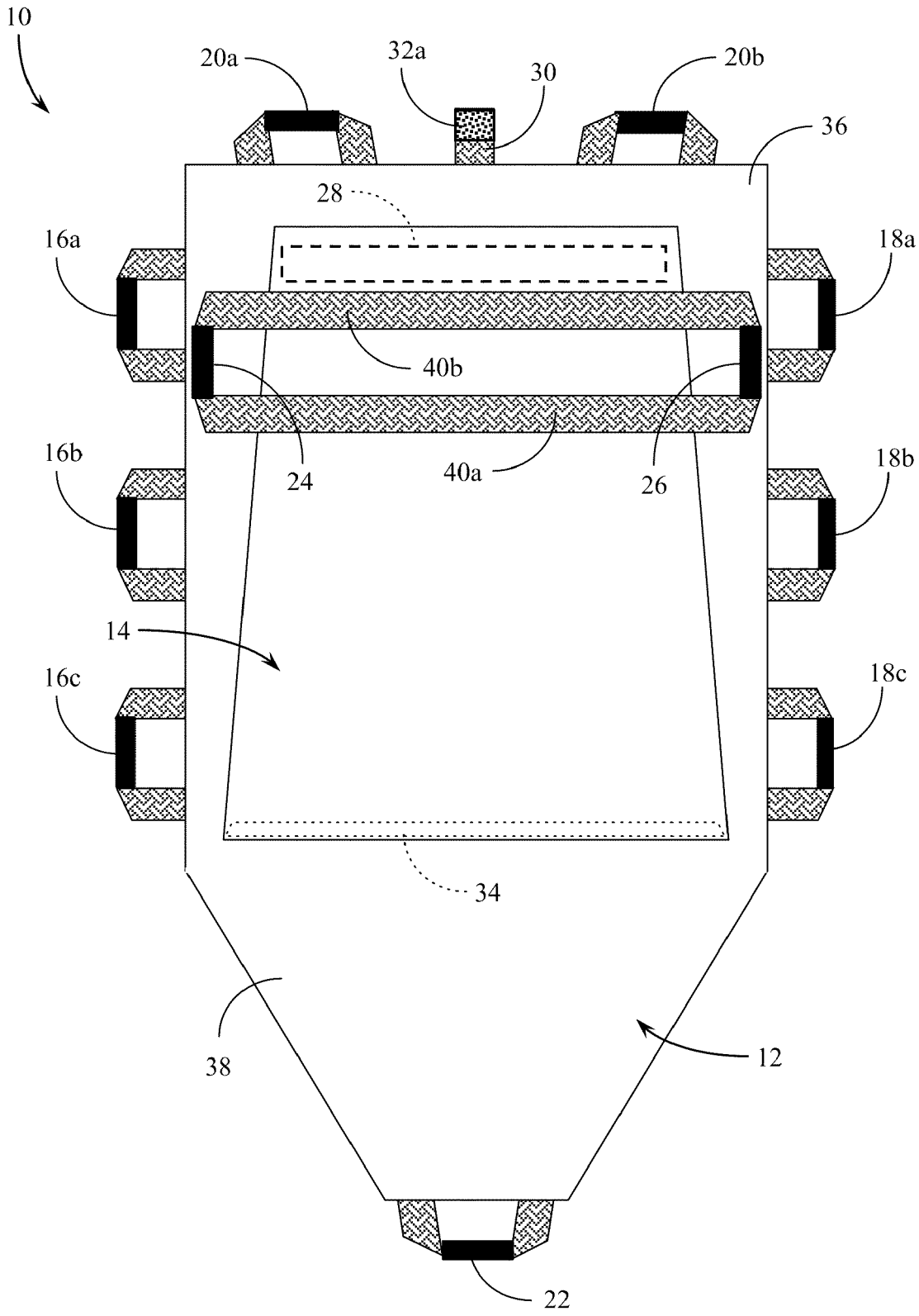
FIG. 1 is a top plan view of the device of the present invention shown in a condition to receive an individual to be transported without the use of the leg extension support surface.

Reference is made first to FIG. 1 for a detailed description of the overall structure of the device of the present invention. FIG. 1 is a top plan perspective view of the device shown in a position to receive the individual being transported without the use of the secondary leg extension support surface. In this configuration an incapacitated individual may be transported, preferably by two assisting individuals, although in extreme cases a single individual may be able to manipulate and secure an incapacitated individual in the configuration shown. Transport surface 10 is generally comprised of primary body sheet 12 and secondary leg extension sheet 14. Configured on a back side of primary body sheet 12 in a manner shown and described in more detail below is an array of straps forming right side hand holds 16*a*-16*c* as well as left side hand holds 18*a*-18*c*. Additionally positioned along a third edge of primary body sheet 12 are top hand holds 20*a*-20*b*. Finally, positioned at an apex of a triangular portion of primary body sheet 12, is bottom hand hold 22. It should be noted here that left and right orientation references in this description and in the description of the following drawing figures are made from the patient's perspective.

Secondary leg extension sheet 14 in the view shown in FIG. 1 is folded back against primary body sheet 12 in a manner that places it out of the way while not in use. Still visible in this view in association with secondary leg extension sheet 14 are extension sheet right side hand hold 24 and extension sheet left side hand hold 26. Once again, these orientations are from the patient's view when the patient is placed on the device of the present invention in its unextended configuration (the configuration shown in FIG. 1). Extension sheet retention strip 28 shown in dashed outline view in FIG. 1, provides a manner of retaining secondary leg extension sheet 14 closed and flat against primary body sheet 12. In the preferred embodiment of the present invention, extension sheet retention strip 28 may be mating surfaces of a hook and loop material such as Velcro®.

Also shown in FIG. 1 is closure tab 30 which extends from the back side of primary body sheet 12 and retains one-half of closure tab retention surface 32*a* which like retention strip 28 is preferably one half of a hook and loop material such as Velcro®. The placement and purpose of closure tab 30 as a manner of retaining the device of the present invention in a folded and rolled configuration is described in more detail below.

Figure 3:
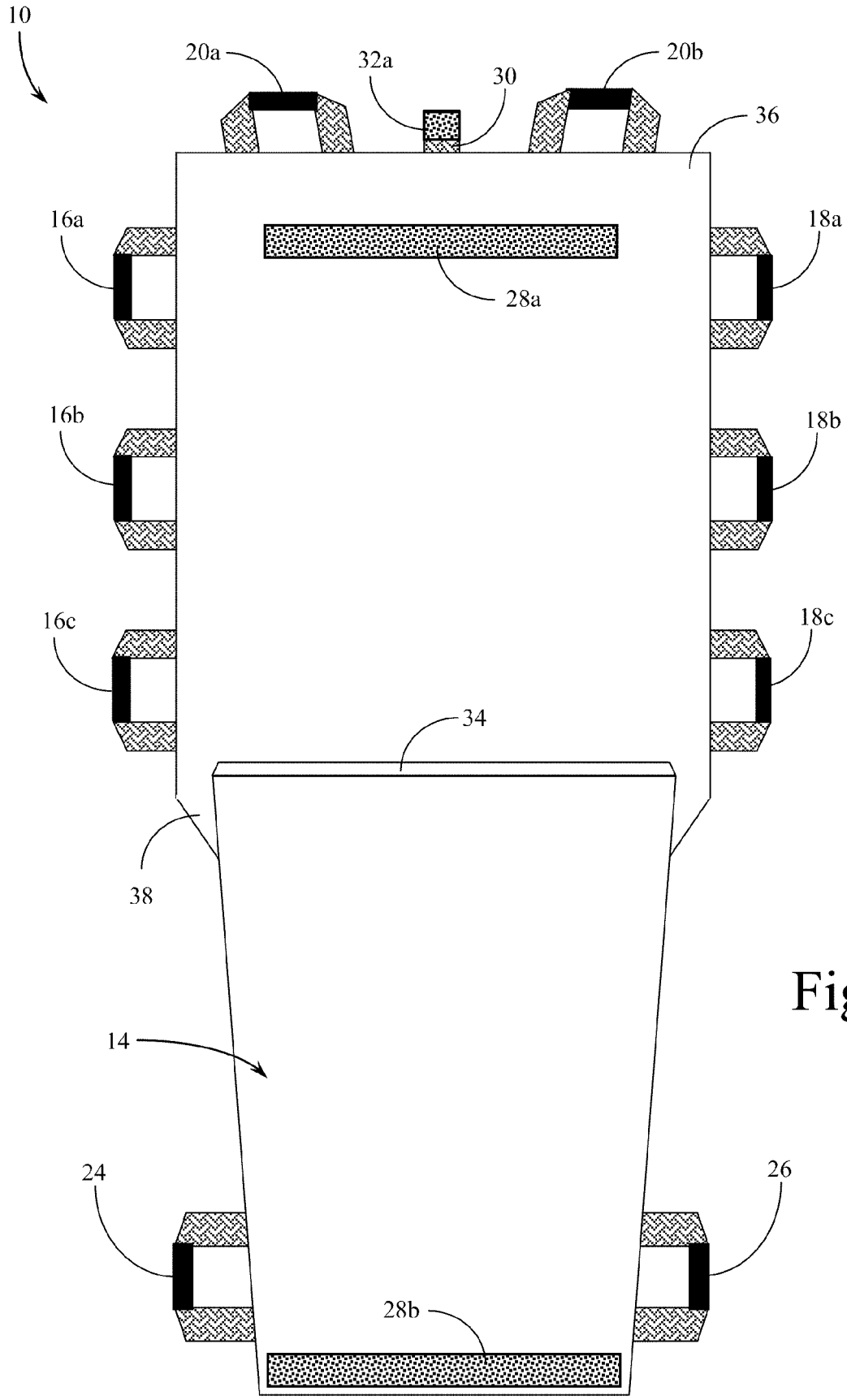
FIG. 3 is a top plan view of the device of the present invention shown with the leg extension support surface folded out to receive an individual for transport.
Figure 4:
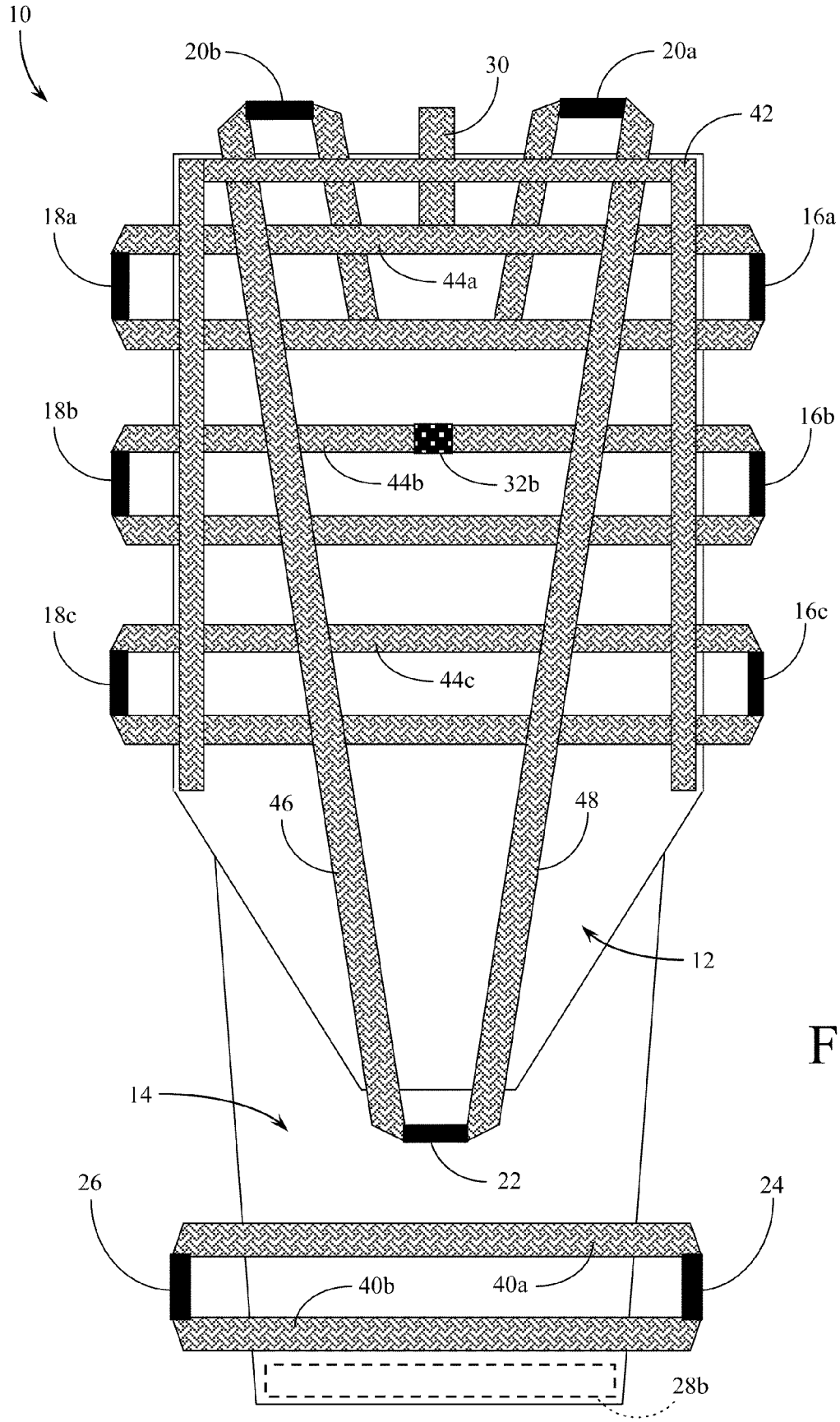
FIG. 4 is the reverse view of the device of the present invention as shown in FIG. 3, again with the leg extension support surface folded out to receive the individual to be transported.

Secondary leg extension sheet 14 is retained on primary body sheet 12 at extension sheet hinge seam 34. In the preferred embodiment of the present invention, both primary body sheet 12 and secondary leg extension sheet 14 are manufactured from nylon or polyester reinforced vinyl tarpaulin material that in addition to providing a smooth and waterproof surface for placement of the incapacitated individual also provides a strong and tear resistant sheetlike material that provides a rugged fabric to which the various webbing straps of the present invention may be sewn. The manner of sewing and attaching the support straps utilized in the present invention is described in more detail below. The extension sheet hinge seam 34 provides a manner of pivoting secondary leg extension sheet 14 from an unused, closed position against primary body sheet 12 to an extended position as shown in FIGS. 3 and 4 described in detail below.

The device of the present invention thus assembled and as described above provides an upper body support surface 36 that is bounded by right side hand holds 16*a*-16*c*, left side hand holds 18*a*-18*c* and on a third side at top hand holds 20*a* and 20*b*. Also provided by the structure shown and described is lower body support surface 38 which is provided with and is supported by bottom hand hold 32.

Use of the patient transport surface structured as shown involves placement of the device on a flat surface adjacent to the patient to be transported and movement of the incapacitated individual onto the surface such that the torso of the individual's body is centered on upper body support surface 36. In this manner, the legs of the individual may extend on either side of the triangular portion of lower body support surface 38. The use of the present invention in its unextended form allows for a more compact transport surface that may be useful when there are only two individuals assisting with the transport of the incapacitated individual, or where the environment severely confines movement when carrying the individual. The variety of the available loop hand holds positioned on the primary body sheet perimeter, as well as the bottom hand hold positioned at the apex of the lower triangular portion of primary body sheet 12, allow a wide variety and number of emergency personnel and/or healthcare providers to assist with the transport of the patient positioned on the transport surface 10.

Shown in the view of FIG. 1 wherein secondary leg extension sheet 14 is folded back against primary body sheet 12 is also the basic configuration of the support straps associated with the overall device of the present invention. A single set of support straps 40*a* and 40*b* form a loop which extends beyond the edge of secondary leg support extension 14 and thereby establishes loop hand holds comprising extension sheet right hand hold 24 and extension sheet left side hand hold 26. The web material straps that form these extension sheet support straps 40*a* and 40*b* are, in the preferred embodiment, two inches wide and made of heavy polyester or nylon woven material. This material is such that it may easily be sewn onto the surface (the back side surface, in this case) of secondary leg extension sheet 14 which, as described above, is comprised of a polyester or nylon reinforced vinyl sheet material that resists tearing and puncturing. In this manner, the attachment of the straps to the sheet like material is essentially the process of sewing together two heavy duty fabric materials made up of strong polyester filaments or the like. The manner of the attachment of similar straps to the back side of primary body sheet 12 is similar and is described in more detail below.

Figure 2:
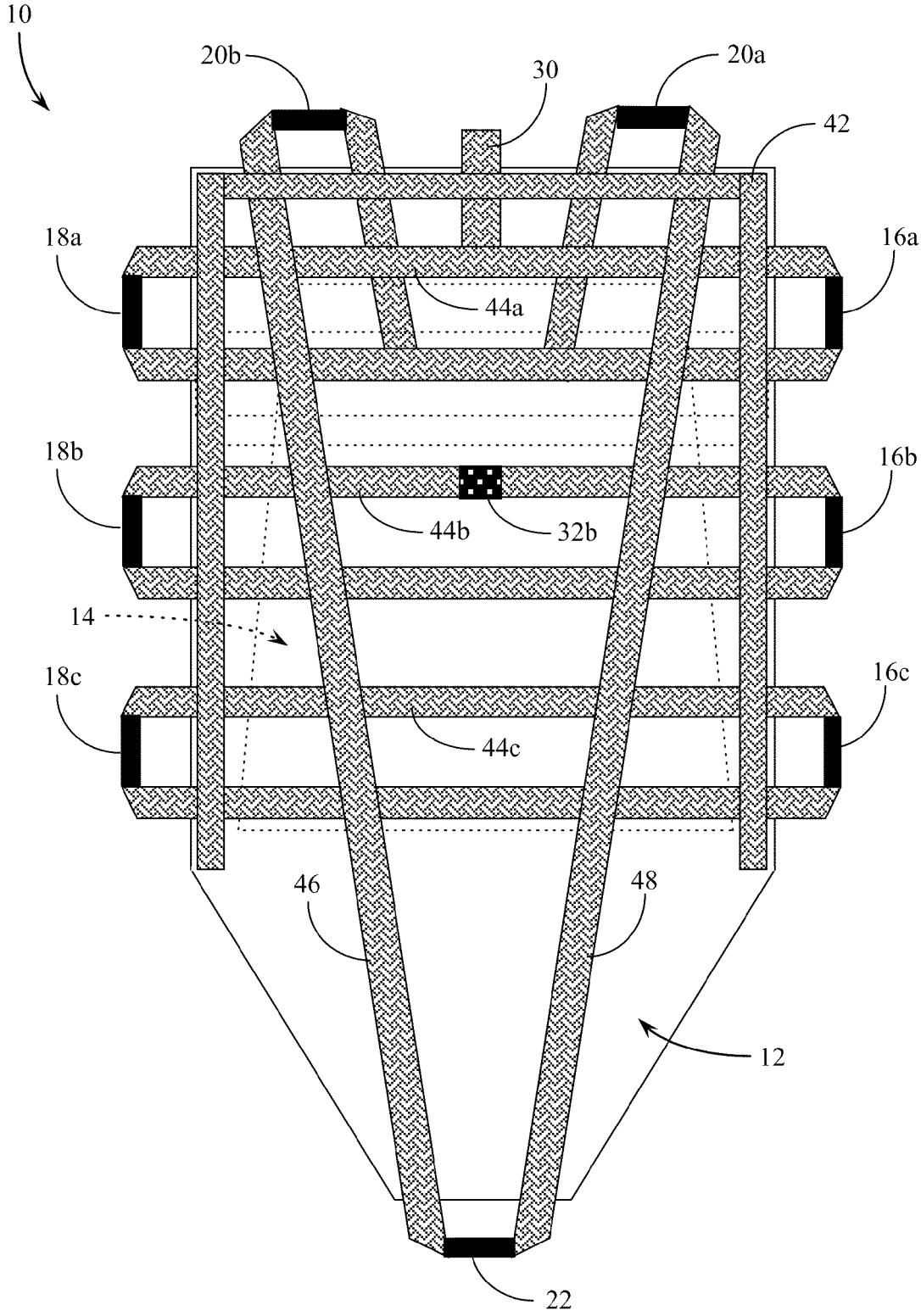
FIG. 2 is the reverse view of the device of the present invention as shown in FIG. 1.

Reference is now made to FIG. 2 for a description of the underside or back side structure of the device of the present invention in the arrangement shown and described above with respect to FIG. 1. FIG. 2 shows the device of the present invention still in its unextended form wherein secondary leg extension sheet 14 remains folded up against primary body sheet 12. In this view, secondary leg extension sheet 14 is shown in dashed outline form.

The arrangement and placement of the two inch wide web straps described above on the back side of primary body sheet 12 provides a critical element of the present invention. Hand holds 16*a*-16*c* as well as 18*a*-18*c* are each formed from single loops of cross body support straps 44*a*-44*c* as shown. The actual terminal ends of the individual sections of web straps are positioned preferably within a center region of primary body sheet 12 at a point that experiences less significant tension or repeated stress. Nonetheless, the straps themselves may be sewn in their entirety to the back side of the surface of primary body sheet 12 in the configuration shown in FIG. 2. Also shown in FIG. 2 is closure tab retention surface 32*b* sewn into place on cross body support strap 44*b* to be used with closure tab 30 in a manner described below.

Left side longitudinal support strap 46 and right side longitudinal support strap 48 cross over each of cross body supports straps 44*a*-44*c* and are sewn to such straps in a manner described in detail below (in FIG. 6). This further adheres each of the cross body support straps 44*a*-44*c* to the primary body sheet 12. In addition, the cross wise orientation provides a firm establishment function to the overall sheet configuration. It assists those individuals attending to the transport of the patient if the device of the present invention, albeit flexible, retains some of the general planar form in a manner that allows for the placement of the patient onto the surface with little or no attention to manually forming the surface on the ground as might be required with an unreinforced sheet of material.

Further facilitating this functionality are perimeter support straps 42 which follow the edge of primary body sheet 12 along its right and left hand sides as well as the top side. The bottom side, formed of a triangular section with an apex at bottom handle 22, remains without a perimeter strap, primarily to facilitate its function as a surface over which the legs of the individual may extend. Perimeter support straps 42 on the other hand provide the necessary form expansion functionality as well as further reinforcement of the attachment of the hand holds to the perimeter edge of the overall transport surface.

In the preferred embodiment of the present invention, left side longitudinal support strap 46 extends from a starting point positioned underneath cross body support strap 44*a* through top hand hold 20*b* and back down along the length of primary body sheet 12 through bottom hand hold 22 becoming left side longitudinal support strap 48 which then passes through and forms top hand hold 20*a* to be turned back underneath cross body support strap 44*a* where the terminal end thereof is again sewn and retained between cross body support strap 44*a* and the underside surface of primary body sheet 12

Reference is now made to FIG. 3 for a detailed description of the device of the present invention in an expanded form wherein the leg support component of the device has been extended out to receive the legs of the individual to be transported. FIG. 3 provides the same perspective as the view shown in FIG. 1, but with secondary leg extension sheet 14 shown in its extended configuration. In this view, extension sheet retention strip 28 is shown to be comprised of first strip section 28*a* and second strip section 28*b* which as indicated above are preferably mating surfaces of a hook and loop (Velcro®) material. Once separated in this manner, secondary leg extension sheet 14 may be rotated away from the surface of primary body sheet 12 along extension sheet hinge seam 34 to a fully extended position in a longitudinal direction along a central axis of primary body sheet 12. This configuration effectively extends the overall support surface of the present invention such that the legs of the incapacitated individual may be supported in a manner similar to the torso of the individual. Extension sheet hinge seam 34 is structured in such a manner as to provide flexibility similar to the overall flexibility of the reinforced vinyl sheet material itself.

Reference is now made to FIG. 4 for a detailed description of the expanded configuration of the device of the present invention as shown and described above in conjunction with FIG. 3. FIG. 4 shows the same configuration of the device of the present invention as presented in FIG. 3 from the back side view showing all of the various components previously shown and described in FIG. 1 with regard to the back side of secondary leg extension sheet 14 and FIG. 2 with regard to the balance of the web strap components attached to the back side of primary body sheet 12. The additional feature shown in FIG. 2 and FIG. 4 as described above is closure tab retention surface 32*b* which, as mentioned, comprises the second half of a mating surface of a hook and loop material (Velcro®) the manner of attachment of 32*a* and 32*b* as described in more detail below.

Figure 5:
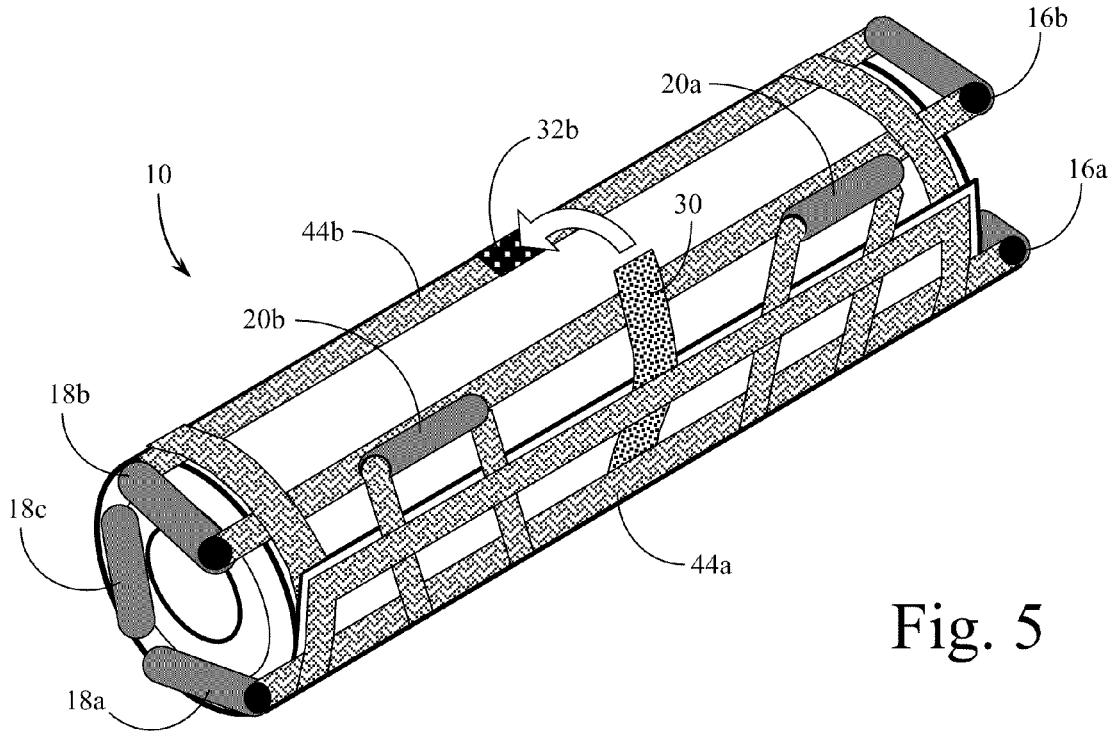
FIG. 5 is a perspective view of the device of the present invention shown in a collapsed/rolled-up configuration suitable for storage and transport.

Reference is next made to FIG. 5 for a brief description of the manner in which the device of the present invention may be collapsed, folded, and rolled up for storage and transport when not in use or immediately prior to use. As indicated above, the device of the present invention lends itself to folding and rolling into an easily transportable configuration. One of the primary objectives of the present invention is to provide a device that may be easily moved to the location of the incapacitated individual and thereafter unrolled or unfolded into a configuration onto which the patient may be placed. FIG. 5 shows the device of the present invention in its rolled and closed configuration. In this view, the top edge of transport surface 10 provides the exterior edge to the rolled configuration with the back side of the device forming the exterior of the roll. In this manner, closure tab retention surfaces 32*a* and 32*b* positioned and shown as described above, match and mate to allow closure tab 30 to secure the top edge of transport surface 10 back onto itself in a manner that retains the cylindrical roll secure and closed. In this manner also, the various loop handles described above are positioned external to the cylindrical roll either at its ends (side hand holds 16*a*-16*c* and 18*a*-18*c*) or along its length (top hand holds 20*a* and 20*b*). In any case, the configuration shown in FIG. 5 provides an easy compact configuration to be stored and/or to be moved to the location of the patient requiring assistance.

Figure 6:
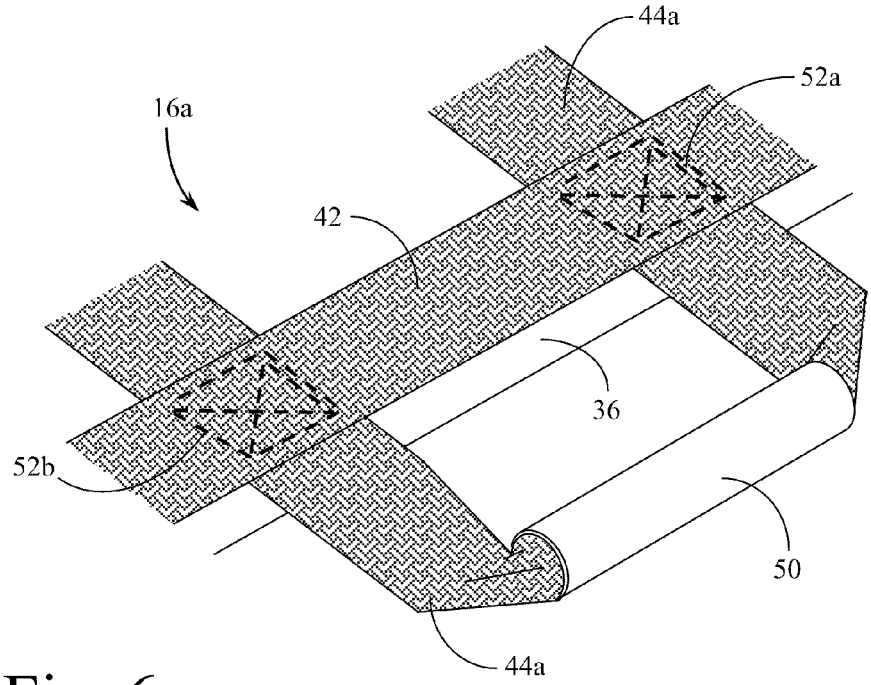
FIG. 6 is a detailed perspective view of a representative one of the loop hand holds showing the manner of forming and attaching the same to the support surfaces of the present invention.

Reference is finally made to FIG. 6 for a detailed perspective view of the manner in which the loop hand holds of the present invention are configured. In this view, right side hand hold 16*a*, as an example, is shown to be constructed from cross body support strap 44*a* which is preferably a single piece of two inch web strap affixed to the back side of upper body support surface 36 as shown. The strap 44*a* extends past the perimeter of the primary body sheet 12 and is then compressed or rolled to fit through the internal diameter of flexible tubular handle 50 as shown. Extending out from the opposite end of flexible tubular handle 50, the strap 44*a* then reattaches to the back side of upper body support surface 36 in a manner that offers an uninterrupted section of strap 44*a* as the strong support for the hand hold 16*a*. Cross strap stitchings 52*a* and 52*b* are sewn (typical throughout the present invention) with heavy duty polyester thread through both perimeter support strap 42 and cross body support strap 44*a* and finally through upper body support surface 36 to secure and close the loop hand hold thus constructed.

Although the present invention has been described in terms of the foregoing preferred embodiments, this description has been provided by way of explanation only, and is not intended to be construed as a limitation of the invention. Those skilled in the art will recognize modifications of the present invention that might accommodate specific emergency and/or medical patient transport situations, as well as variations in the anticipated size and weight of the incapacitated individuals. Such modifications, as to configuration, geometry, size and materials, where such modifications are coincidental to the type of patient or incapacitated individual being served, do not necessarily depart from the spirit and scope of the invention.

I claim:

1. An apparatus for facilitating the transport of an incapacitated individual by one or more assisting individuals, the apparatus comprising:

a first sheet of flexible material comprising an upper and middle body support surface for the incapacitated individual, the first sheet of flexible material having a perimeter edge, the first sheet of flexible material further comprising;

a generally rectangular upper body support surface section partially bordered by generally parallel left and right side portions, and a generally orthogonal top portion, of the perimeter edge of the first sheet of flexible material; and a generally triangular middle body support surface section bordered by generally converging acute angle bottom portion of the perimeter edge of the first sheet of flexible material;

a first array of support straps positioned under and attached to the first sheet of flexible material, the first array of support straps arranged to define a plurality of loop hand holds at the perimeter edge of the first sheet of flexible material, at least one loop hand hold positioned on each of the right side portion of the perimeter edge, the left side portion of the perimeter edge, the top portion of the perimeter edge, and proximate to an apex of the converging acute angle bottom portion of the perimeter edge;

a second sheet of flexible material comprising a lower body extension support surface for the incapacitated individual, the second sheet of flexible material having a perimeter edge, the second sheet of flexible material comprising a generally trapezoidal shape having a long perimeter edge portion and a parallel short perimeter edge portion, the second sheet of flexible material further attached to the first sheet of flexible material along the long portion of the perimeter edge of the second sheet so as to fold from a first position generally flat against and within the perimeter edge of the first sheet to a second position extending generally beyond the perimeter edge of and apart from the first sheet; and a second array of support straps positioned under and attached to the second sheet of flexible material, the second array of support straps arranged to define a plurality of loop hand holds at the perimeter edge of the second sheet of flexible material, at least one loop hand hold positioned on each of the non-parallel sides of the perimeter edge of the second sheet.

2. The apparatus of claim 1 further comprising at least one perimeter support strap positioned under and attached to the first sheet of flexible material, the at least one perimeter support strap following a major portion of the perimeter edge of the first sheet of flexible material.

3. The apparatus of claim 1 further comprising at least two removable attachment surfaces positioned on the first and second sheets of flexible material in a manner that aligns the removable attachment surfaces when the second sheet of flexible material is in the first position generally within the perimeter edge of and flat against the first sheet.

4. The apparatus of claim 1 wherein the first array of support straps comprises lengths of straps of woven polymer fiber material and each of the plurality of loop hand holds comprise:

an uninterrupted looped portion of a length of strap extending beyond the perimeter edge of the first sheet of flexible material; and a section of flexible cylindrical tubing, the looped portion of a length of strap threaded through the section of flexible tubing.

5. The apparatus of claim 1 wherein the second array of support straps comprises lengths of straps of woven polymer fiber material and each of the plurality of loop hand holds comprise:

an uninterrupted looped portion of a length of strap extending beyond the perimeter edge of the second sheet of flexible material; and a section of flexible cylindrical tubing, the looped portion of a length of strap threaded through the section of flexible tubing.

6. The apparatus of claim 1 further comprising a storage strap for retaining the apparatus in a rolled, generally cylindrical storage configuration, the storage strap comprising:

a closure strap comprising a length of strap of woven polymer fiber material positioned on the first sheet of flexible material and partially extending outside the perimeter edge of the first sheet, the closure strap having one of a pair of removable attachment surfaces positioned thereon;

an attachment pad comprising a second one of the pair of removable attachment surfaces, mateable to the attachment surface of the closure strap, positioned on the first sheet of material at a point that aligns with the closure strap when the apparatus is rolled into a generally cylindrical storage configuration.

7. The apparatus of claim 1 wherein the first and second sheets of flexible material are each constructed of polymer fiber reinforced vinyl tarpaulin fabric material.

8. The apparatus of claim 1 wherein the first and second arrays of support straps are respectively attached to the first and second sheets of flexible material by sewn polymer fiber thread.

9. The apparatus of claim 2 wherein the at least one perimeter support strap crosses in at least one intersection, the first array of support straps and is attached to the support strap at each such intersection by sewn polymer fiber thread.

* * * * *